US010971072B2

(12) United States Patent
Chen et al.

(10) Patent No.: US 10,971,072 B2
(45) Date of Patent: Apr. 6, 2021

(54) METHOD AND DEVICE FOR DRIVING DISPLAY PANEL

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Wei Chen, Beijing (CN); Chun Cao, Beijing (CN); Haixia Xu, Beijing (CN); Fei Yang, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/829,215

(22) Filed: Mar. 25, 2020

(65) Prior Publication Data

US 2020/0410936 A1 Dec. 31, 2020

(51) Int. Cl.

| | |
|---|---|
| ***G09G 5/00*** | (2006.01) |
| ***G09G 3/3258*** | (2016.01) |
| *G09G 3/20* | (2006.01) |

(52) U.S. Cl.

CPC ..... *G09G 3/3258* (2013.01); *G09G 3/2003* (2013.01); *G09G 2320/0646* (2013.01)

(58) Field of Classification Search

CPC ..... G09G 3/2003; G09G 3/3258; G09G 5/00; G09G 2320/0646

See application file for complete search history.

(56) References Cited

U.S. PATENT DOCUMENTS

| | | | | |
|---|---|---|---|---|
| 9,214,134 | B2 * | 12/2015 | Yang | G09G 5/10 |
| 2009/0207182 | A1 * | 8/2009 | Takada | G09G 3/3607 345/589 |
| 2013/0241810 | A1 * | 9/2013 | Higashi | G09G 3/3406 345/77 |
| 2013/0335457 | A1 * | 12/2013 | Yano | G09G 3/3208 345/690 |
| 2014/0267471 | A1 * | 9/2014 | Harada | G09G 5/04 345/694 |
| 2016/0253953 | A1 * | 9/2016 | Yang | G09G 3/2074 345/214 |
| 2016/0260395 | A1 * | 9/2016 | Sako | G09G 3/3426 |
| 2017/0069251 | A1 * | 3/2017 | Yang | G09G 3/2003 |
| 2018/0033380 | A1 * | 2/2018 | An | G06T 7/001 |
| 2018/0061368 | A1 * | 3/2018 | Sako | G06T 5/007 |
| 2018/0174528 | A1 * | 6/2018 | Botzas | G09G 5/10 |

(Continued)

*Primary Examiner* — Joe H Cheng

(74) *Attorney, Agent, or Firm* — Nath, Goldberg & Meyer; Joshua B. Goldberg

(57) ABSTRACT

The present disclosure provides a method and a device for driving a display panel. The method of the present disclosure includes: determining a plurality of candidate time differences according to a highest brightness threshold of the sub-pixels of each color; for each candidate time difference, displaying, by the display panel, a same test picture using the candidate time difference, and detecting picture display quality of the display panel when the test picture is displayed by the display panel using the candidate time difference; and determining a candidate time difference corresponding to an optimal picture display quality as the time difference.

14 Claims, 4 Drawing Sheets

(56) References Cited

U.S. PATENT DOCUMENTS

| | | | | |
|---|---|---|---|---|
| 2018/0240410 | A1* | 8/2018 | Yang | G09G 3/3291 |
| 2018/0308422 | A1* | 10/2018 | Hwang | G09G 3/3208 |
| 2019/0130837 | A1* | 5/2019 | Chen | G09G 3/3233 |
| 2019/0147801 | A1* | 5/2019 | Chu | G09G 3/3233 345/76 |
| 2019/0213941 | A1* | 7/2019 | Beon | G09G 3/006 |
| 2020/0014858 | A1* | 1/2020 | Chesnokov | H04N 5/23212 |
| 2020/0202792 | A1* | 6/2020 | Meng | G09G 3/3233 |
| 2020/0327839 | A1* | 10/2020 | Lin | G09G 3/3225 |

* cited by examiner

METHOD AND DEVICE FOR DRIVING DISPLAY PANEL

CROSS-REFERENCE TO RELATED APPLICATION

This application claims the benefit of priority to Chinese Patent Application No. 201910579469.8 filed on Jun. 28, 2019, the contents of which are incorporated herein in their entirety by reference.

TECHNICAL FIELD

The present disclosure relates to the field of display technology, and particularly relates to a method and a device for driving a display panel.

BACKGROUND

Organic light emitting diode (OLED) display apparatuses are self-emissive apparatuses, and do not require backlights. OLED display apparatuses also provide more vivid colors and a larger color gamut as compared to the conventional liquid crystal display (LCD) apparatuses. Further, OLED display apparatuses can be made more flexible, thinner, and lighter than a typical LCD apparatus.

SUMMARY

In an aspect, the present disclosure provides a method for driving a display panel, the display panel includes a plurality of sub-pixels of different colors, each sub-pixel including a driving element, a first switch, a second switch, and a light emitting device; a control terminal of the first switch is coupled to a first control terminal, a first terminal of the first switch is coupled to a data line, and a second terminal of the first switch is coupled to a control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device. The method includes: during a period of writing a data signal to any one of the plurality of sub-pixels, simultaneously providing an on signal to the first control terminal and the second control terminal of the sub-pixel, and then providing an off signal to the second control terminal before providing an off signal to the first control terminal. A time difference between providing the off signal to the first control terminal and providing the off signal to the second control terminal is determined by: determining a plurality of candidate time differences according to a highest brightness threshold of the sub-pixels of each color; for each candidate time difference, displaying, by the display panel, a same test picture using the candidate time difference, and detecting picture display quality of the display panel when the test picture is displayed by the display panel using the candidate time difference; and determining a candidate time difference corresponding to an optimal picture display quality as the time difference.

In some embodiments, for each candidate time difference, steps of displaying, by the display panel, the same test picture using the candidate time difference, and detecting picture display quality of the display panel when the test picture is displayed by the display panel using the candidate time difference include: displaying, by the display panel, a first test picture using the candidate time difference, wherein the first test picture includes a first pure color sub-picture and a second pure color sub-picture which are respectively in a first area and a second area which are adjacent to each other, the first pure color sub-picture has a first gray level, and the second pure color sub-picture has a second gray level; displaying, by the display panel, a second test picture using the candidate time difference, wherein the second test picture includes a third pure color sub-picture in both the first area and the second area, the third pure color sub-picture has a third gray level, and the third gray level is between the first gray level and the second gray level; and detecting the picture display quality of the third pure color sub-picture in the first area and the second area.

In some embodiments, detecting the picture display quality of the third pure color sub-picture in the first area and the second area includes: collecting an image of the third pure color sub-picture in the first area and the second area; detecting a brightness difference between a brightness of the third pure color sub-picture in the first area and a brightness of the third pure color sub-picture in the second area; and acquiring the picture display quality of the third pure color sub-picture in the first area and the second area according to the brightness difference.

In some embodiments, collecting the image of the third pure color sub-picture in the first area and the second area includes capturing, by a charge coupled device, an image of the second test picture displayed on the display panel.

In some embodiments, the first test picture includes a plurality of pure color sub-pictures arranged in a matrix, and any two adjacent pure color sub-pictures are the first pure color sub-picture and the second pure color sub-picture, respectively.

In some embodiments, one of the first gray level and the second gray level is a minimum display gray level of the display panel, the other of the first gray level and the second gray level is a maximum display gray level of the display panel, and the third gray level is an intermediate value between the minimum display gray level and the maximum display gray level of the display panel.

In some embodiments, the display panel is restarted before displaying, by the display panel, the test picture using any candidate time difference, and detecting picture display quality of the display panel when the test picture is displayed by the display panel using the candidate time difference.

In some embodiments, the method further includes predetermining a maximum time difference and the highest brightness threshold of the sub-pixels of each color. Determining the plurality of candidate time differences according to the highest brightness threshold of the sub-pixels of each color includes: displaying, by the display panel, a brightness test picture using a current time difference, and at the same time, detecting a highest brightness of the sub-pixels of each color, wherein an initial value of the current time difference is the maximum time difference; judging whether the highest brightness of the sub-pixels of each color is greater than or equal to a corresponding highest brightness threshold; in response to the highest brightness of the sub-pixels of each color being greater than or equal to the corresponding highest brightness threshold, subtracting a predetermined step from the current time difference and repeatedly performing the displaying and the detecting; determining the current time difference as a reference time difference in response to the highest brightness of the sub-pixels of at least one color being less than a corresponding highest brightness threshold; and determining the plurality of candidate time differences according to the reference time difference.

In some embodiments, the plurality of candidate time differences includes: T, T+step, . . . , T+n*step, T−step, . . . , T−m*step, where T is the reference time difference, step is the predetermined step, and m and n are integers greater than 1.

In some embodiments, in a case of the maximum time difference, the highest brightness that the sub-pixels of each color of the display panel are capable of reaching is no less than the highest brightness threshold of the sub-pixels of the color.

In some embodiments, determining a candidate time difference corresponding to an optimal picture display quality as the time difference includes: determining the candidate time difference corresponding to the optimal picture display quality according to a picture evaluation index, wherein the picture evaluation index includes one or any combination of brightness uniformity, highest brightness of sub-pixels of each color, afterimage level and number of mura.

In some embodiments, the number of the picture evaluation indexes is plural, and determining the candidate time difference corresponding to the optimal picture display quality according to the picture evaluation index includes: determining the candidate time difference corresponding to the optimal picture display quality according to priorities of a plurality of picture evaluation indexes.

In another aspect, the present disclosure provides a device for driving a display panel, the display panel includes a plurality of sub-pixels of different colors, each sub-pixel including a driving element, a first switch, a second switch, and a light emitting device; a control terminal of the first switch is coupled to a first control terminal, a first terminal of the first switch is coupled to a data line, and a second terminal of the first switch is coupled to a control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device. The driving device includes: a candidate time difference acquisition device configured to determine a plurality of candidate time differences according to a highest brightness threshold of the sub-pixels of each color; a display driving device configured to cause the display panel to display a same test picture using one of the plurality of candidate time differences, wherein during a period of writing a data signal to any one of the plurality of sub-pixels, the display driving device is configured to simultaneously provide an on signal to the first control terminal and the second control terminal of the sub-pixel, then provide an off signal to the second control terminal before providing an off signal to the first control terminal, and a time difference between providing the off signal to the first control terminal and providing the off signal to the second control terminal is one of the plurality of candidate time differences; a picture quality detection device configured to detect picture display quality of the display panel when the test picture is displayed by the display panel using each candidate time difference; and a time difference determining device configured to determine a candidate time difference corresponding to an optimal picture display quality.

In some embodiments, the picture quality detection device includes:

an image acquisition device configured to acquire an image of the test picture; and an image analysis device configured to determine the picture display quality of the test picture according to the image of the test picture.

DETAILED DESCRIPTION

To enable those skilled in the art to better understand the technical solutions of the present disclosure, the present disclosure will be further described in detail below in conjunction with the accompanying drawings and the specific implementations.

An organic light emitting diode display panel generally has problems of threshold voltage (Vth) shift, mobility variation, and the like of driving elements (such as driving transistors), which in turn cause the organic light emitting diode display panel to have an afterimage, and thus, the organic light emitting diode display panel needs to be compensated during display.

Figure 1:
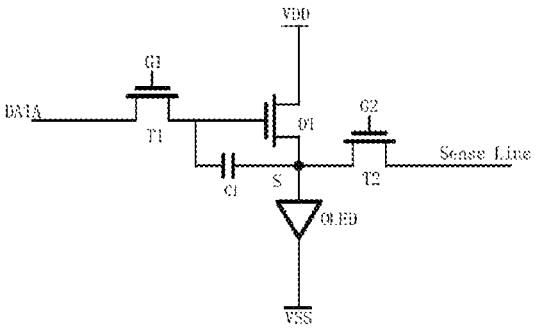
FIG. 1 is a schematic diagram of a 3TIC pixel circuit of a display panel.
Figure 5:
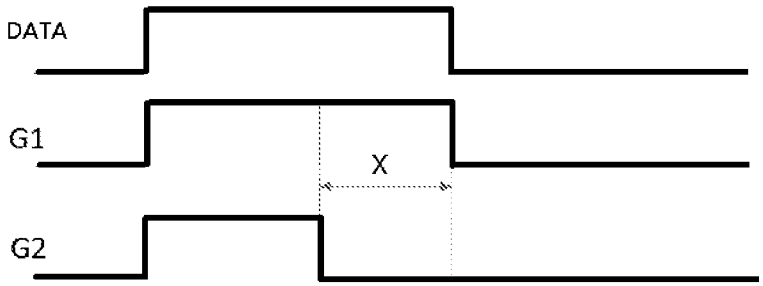
FIG. 5 is an operation timing diagram of a data line, a first switch, and a second switch of a display panel according to an embodiment of the present disclosure.

FIG. 1 is a schematic diagram of a 3TIC pixel circuit of a display panel. As shown in FIG. 1, the pixel circuit includes a driving element DT, a first switch T1, a second switch T2, a light emitting device OLED, and a storage unit C1. A control terminal of the first switch T1 is coupled to a first control terminal G1, a first terminal of the first switch T1 is coupled to a data line DATA, and a second terminal of the first switch T1 is coupled to a control terminal of the driving element DT. A control terminal of the second switch T2 is coupled to a second control terminal G2, a first terminal of the second switch T2 is coupled to a sensing line Sense Line, and a second terminal of the second switch T2 is coupled to a first terminal of the driving element DT and a first terminal of the light emitting device OLED. A second terminal of the driving element DT is coupled to a first voltage terminal VDD. A second terminal of the light emitting device OLED is coupled to a second voltage terminal VSS. A first terminal of the storage unit C1 is coupled to the control terminal of the driving element DT, and a second terminal of the storage unit C1 is coupled to the first terminal of the light emitting device OLED. As shown in FIG. 5, in the write phase of each pixel circuit, an on signal is provided to the first control terminal G1 and the second control terminal G2, and an off signal is provided to the second control terminal G2 ahead of time, and the period X ahead of time is "driving time difference". When the second switch T2 is turned off ahead of time, the first terminal (point S) of the light emitting device OLED is charged to have an increased voltage, and when the mobility of the driving element increases or the threshold voltage Vth of the driving element decreases, the voltage of point S rises quickly and the gate-source voltage Vgs decreases, and when the mobility of the driving element decreases or the threshold voltage Vth of the driving element increases, the voltage of point S rises slowly and the gate-source voltage Vgs increases. Therefore, the variation(s) in mobility and/or threshold voltage Vth can be compensated (internally compensated) by means of the driving time difference, and the afterimage is alleviated.

However, since an increase in the driving time difference reduces the overall brightness of the display panel, it is an urgent problem to be solved to easily and efficiently determine the "driving time difference" that can balance the brightness of the display panel and the afterimage problem.

Figure 2:
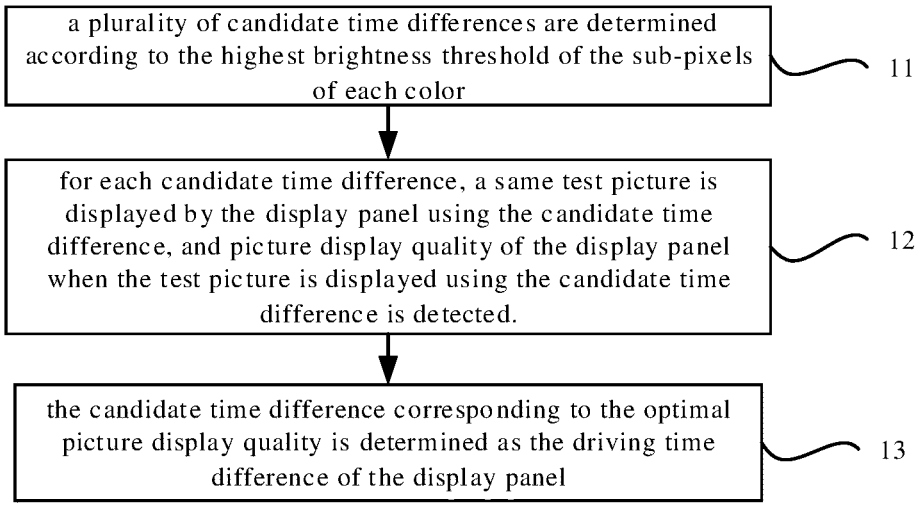
FIG. 2 is a flowchart of a method for determining a driving time difference of a display panel according to an embodiment of the present disclosure.

As shown in FIG. 2, an embodiment of the present disclosure provides a method for determining a driving time difference of a display panel.

A display panel to which the method of the present disclosure is applicable includes a plurality of sub-pixels of different colors, each sub-pixel including a driving element, a first switch, a second switch, a light emitting device, and a storage unit; a control terminal of the first switch is coupled to a first control terminal, a first terminal of the first switch is coupled to a data line, a second terminal of the first switch is coupled to a control terminal of the driving element, and the first switch is configured to transmit a signal provided through the data line to the control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device; the storage unit is coupled between the control terminal of the driving element and the first terminal of the light emitting device.

The method of the present disclosure is applicable to a display panel having a pixel circuit in each sub-pixel, and the pixel circuit has the above structure, so that internal compensation can be provided for the display panel. For example, the pixel circuit is a 3T1C pixel circuit shown in FIG. 1, and the 3T1C pixel circuit includes: a driving transistor DT (driving element), a first transistor T1 (first switch), a second transistor T2 (second switch), a storage capacitor C1 (storage unit), an organic light emitting diode OLED (light emitting device), a data line DATA, a sensing line Sense Line, a first control line G1, and a second control line G2. A drain electrode of the driving transistor DT is coupled to a first power supply VDD; a control electrode of the first transistor T1 is coupled to the first control line G1, a first electrode of the first transistor T1 is coupled to the data line DATA, and a second electrode of the first transistor T1 is coupled to a control electrode of the driving transistor DT and one terminal of the storage capacitor C1, respectively; a control electrode of the second transistor T2 is coupled to the second control line G2, a first electrode of the second transistor T2 is coupled to the sensing line Sense Line, and a second electrode of the second transistor T2 is coupled to a source electrode of the driving transistor DT, the other terminal of the storage capacitor C1, and one terminal of the light emitting device OLED, respectively; the other terminal of the light emitting device OLED is coupled to a second power supply VSS.

It should be understood that the pixel circuit to which the method of the present disclosure is applicable is not necessarily in the form of 3T1C, but may also include more devices as long as it meets the above requirements.

In the case that the display panel displays an image with any time difference, during the period of writing a data signal into any sub-pixel, an on signal is provided to the first control terminal, an on signal and an off signal are provided to the second control terminal in sequence, and the duration of the off signal is equal to the time difference.

In order to balance the brightness and the afterimage problem of the display panel, the first switch and the second switch may be turned off according to a predetermined timing, i.e., the second switch is turned off prior to the first switch in the data writing phase of the sub-pixel, as shown in FIG. 5.

By taking the internal compensation of the 3T1C pixel circuit as an example, referring to FIG. 1, the pixel circuit includes a driving element, a first switch, a second switch, a light emitting device, and a storage unit. During the period of writing a data signal into any sub-pixel, the first control terminal and the second control terminal of the sub-pixel are simultaneously provided with the on signal, and the second control terminal is provided with the off signal ahead of time, and the period ahead of time is the "driving time difference". When the second switch is turned off ahead of time, the first terminal (point S) of the light emitting device is charged to have an increased voltage, and when the mobility of the driving element increases or the threshold voltage Vth of the driving element decreases, the voltage of point S rises quickly and the gate-source voltage Vgs has a larger change, and when the mobility of the driving element decreases or the threshold voltage Vth of the driving element increases, the voltage of point S rises slowly and the gate-source voltage Vgs increases. Therefore, variation(s) in the mobility and/or the threshold voltage Vth can be compensated (internally compensated) by means of the driving time difference, and the afterimage is alleviated.

Referring to FIG. 2, a method for determining the driving time difference X includes steps 11 to 13.

At step 11, a plurality of candidate time differences are determined according to the highest brightness threshold of the sub-pixels of each color. The highest brightness threshold of the sub-pixels of each color may be set according to the brightness requirement of the display panel. In the embodiments of the present disclosure, the highest brightness threshold of the sub-pixels of each color refers to the minimum value that the highest brightness of the sub-pixel of the color needs to reach in order to meet the brightness requirement of the display panel.

In this step, in order to satisfy the brightness requirement of the display panel, any candidate time difference may satisfy the following condition: when the display panel displays an image with the candidate time difference, the highest brightness which can be achieved by the sub-pixels of each color meets one of the following conditions: the highest brightness is greater than the highest brightness threshold of the sub-pixels of the color; and the highest brightness is less than the highest brightness threshold of the sub-pixels of the color and a difference of the highest brightness from the highest brightness threshold of the sub-pixels of the color is less than a difference threshold. The difference threshold is set according to the actual situation of the display panel, so that when the difference between the highest brightness corresponding to the sub-pixels of at least one color and the highest brightness threshold is the difference threshold, the corresponding picture display quality is not degraded to a great extent as compared to the case that the highest brightness that can be achieved by the sub-pixels of each color is greater than the corresponding highest brightness threshold.

At step 12, for each candidate time difference, a same test picture is displayed by the display panel using the candidate time difference, and picture display quality of the display panel when the test picture is displayed by the display panel using the candidate time difference is detected.

In this step, in order to avoid the influence of factors other than the time difference on the picture display quality of the test picture, when the picture display quality is detected for each candidate time difference, the test picture displayed on the display panel is the same, that is, other display parameters, such as picture color, picture brightness, picture display duration, and the like, except the "time difference", are the same.

At step 13, the candidate time difference corresponding to the optimal picture display quality is determined as the driving time difference X of the display panel.

In the method, a plurality of candidate time differences which can basically meet the highest brightness requirement of the display panel are determined, then, a detection device is adopted to detect the picture display quality of the test picture corresponding to any candidate time difference, and the candidate time difference corresponding to the optimal picture display quality is selected from the plurality of candidate time differences.

Meanwhile, the evaluation indexes for evaluating the picture display quality of the test picture may include brightness uniformity, the highest brightness of the sub-pixels of each color, afterimage level, the number of mura, and the like, and these evaluation indexes are directly or indirectly related to the brightness of the test picture. Because the brightness of the test picture exists objectively and the detection device can accurately acquire the brightness of the test picture, the method of the present disclosure can be used to objectively evaluate the picture display quality of the test picture on the display panel. Compared to the case of evaluating the picture display quality of the display panel by human visual inspection, the method of the present disclosure can judge the picture display quality of the display panel more objectively and accurately, so that the determined driving time difference X can better balance the brightness and the afterimage problem of the display panel.

The afterimage is a residual image of an original picture on the display panel when the display panel is switched to display another picture after displaying the original picture for a long time.

Figure 3:
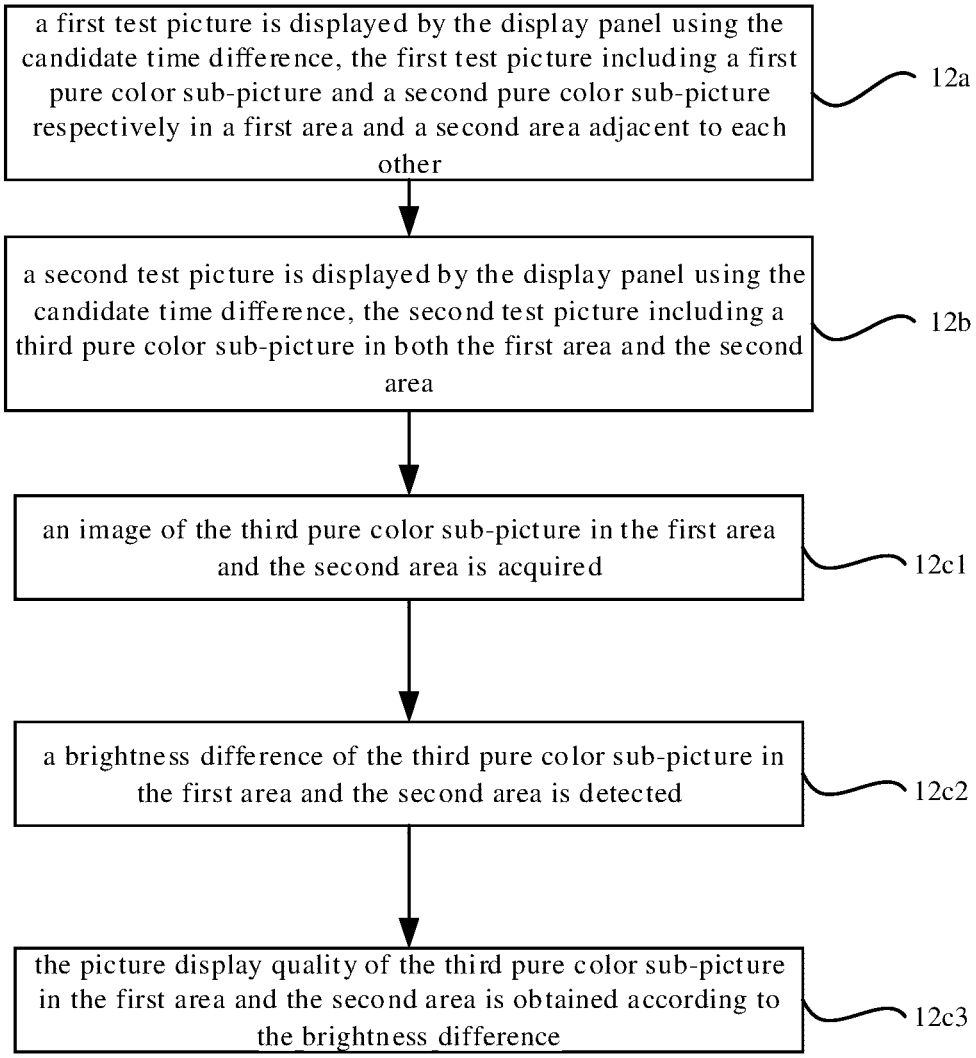
FIG. 3 is a flowchart of a method for determining a driving time difference of a display panel according to another embodiment of the present disclosure.

To perform the afterimage detection, in some embodiments, referring to FIG. 3, step 12 includes step 12*a*, step 12*b*, and step 12*c*.

At step 12*a*, a first test picture is displayed by the display panel using the candidate time difference. The first test picture includes a first pure color sub-picture and a second pure color sub-picture which are respectively positioned in a first area and a second area, the first area and the second area being adjacent to each other, the first pure color sub-picture has a first gray level, and the second pure color sub-picture has a second gray level.

In this step, "adjacent" includes adjacent in the horizontal direction, or adjacent in the vertical direction.

At step 12*b*, a second test picture is displayed by the display panel using the candidate time difference. The second test picture includes a third pure color sub-picture positioned in both the first area and the second area, the third pure color sub-picture has a third gray level, and the third gray level is larger than one of the first gray level and the second gray level and smaller than the other one of the first gray level and the second gray level.

In this step, the third gray level is between the first gray level and the second gray level, so that when the display panel is switched to display the second test picture, not only the afterimage generated by transition from the high gray level to the low gray level but also the afterimage generated by transition from the low gray level to the high gray level can be detected. Therefore, the picture display quality of the test picture on the display panel can be comprehensively evaluated.

At step 12*c*, the picture display quality of the third pure color sub-picture in the first area and the second area is detected.

In some embodiments, step 12*c* includes step 12*c*1, step 12*c*2, and step 12*c*3.

At step 12*c*1, an image of the third pure color sub-picture in the first area and the second area is acquired.

In this step, acquiring the images of the third pure color sub-picture in the first area and the second area may include capturing an image of the second test picture displayed on the display panel through a charge coupled device (CCD).

At step 12*c*2, a brightness difference between a brightness of the third pure color sub-picture in the first area and a brightness of the third pure color sub-picture in the second area is detected.

In this step, the brightness of the third pure color sub-picture in the first area and the second area can be obtained by: analyzing the three primary color values of the captured image and calculating brightness values of the captured image based on the three primary color values of the captured image.

At step 12*c*3, the picture display qualities of the third pure color sub-picture in the first area and the second area are obtained according to the brightness difference.

In this step, the index for evaluating the picture display quality may include brightness uniformity, afterimage level, number of mura, and the like. For example, when the brightness difference is 0% to 4%, the afterimage level is L0; when the brightness difference is 4% to 6%, the afterimage level is L1; when the brightness difference is 6% to 8%, the afterimage level is L2; when the brightness difference is 8% to 12%, the afterimage level is L3; when the brightness difference is 12% to 15%, the afterimage level is L4. In other embodiments, the correspondence between the brightness difference and the afterimage level may also be set according to actual requirements.

In some embodiments, when the second test picture is displayed on the display panel, the brightness of each sub-picture in the second test picture may be directly collected by an optical measurement device (e.g., a fiber probe disposed at the position of each sub-picture).

In order to detect picture display quality of the entire display area of the display panel and obtain more brightness contrast data, the first test picture in step 12*a* may include a plurality of pure color sub-pictures arranged in a matrix, and the gray levels of any two adjacent pure color sub-pictures are the first gray level and the second gray level, respectively.

In some embodiments, one of the first gray level and the second gray level is a minimum display gray level L0 of the display panel, the other of the first gray level and the second gray level is a maximum display gray level L255 of the display panel, and the third gray level is an intermediate value L60 between the minimum display gray level and the maximum display gray level of the display panel. As such, the accuracy of detecting the picture display quality of the test picture on the display panel can be improved.

In step 12, before the test picture is displayed by the display panel using any candidate time difference, and picture display quality of the display panel when the test picture is displayed by the display panel using the candidate time difference is detected, the display panel is restarted, so as to perform shutdown compensation.

In this embodiment, the purpose of the shutdown compensation is to prevent the detection result of the picture display quality of the test picture corresponding to any candidate time difference from being affected by the previous picture. The previous picture here may refer to any picture before the first test picture in the test pictures corresponding to any candidate time difference.

Figure 4:
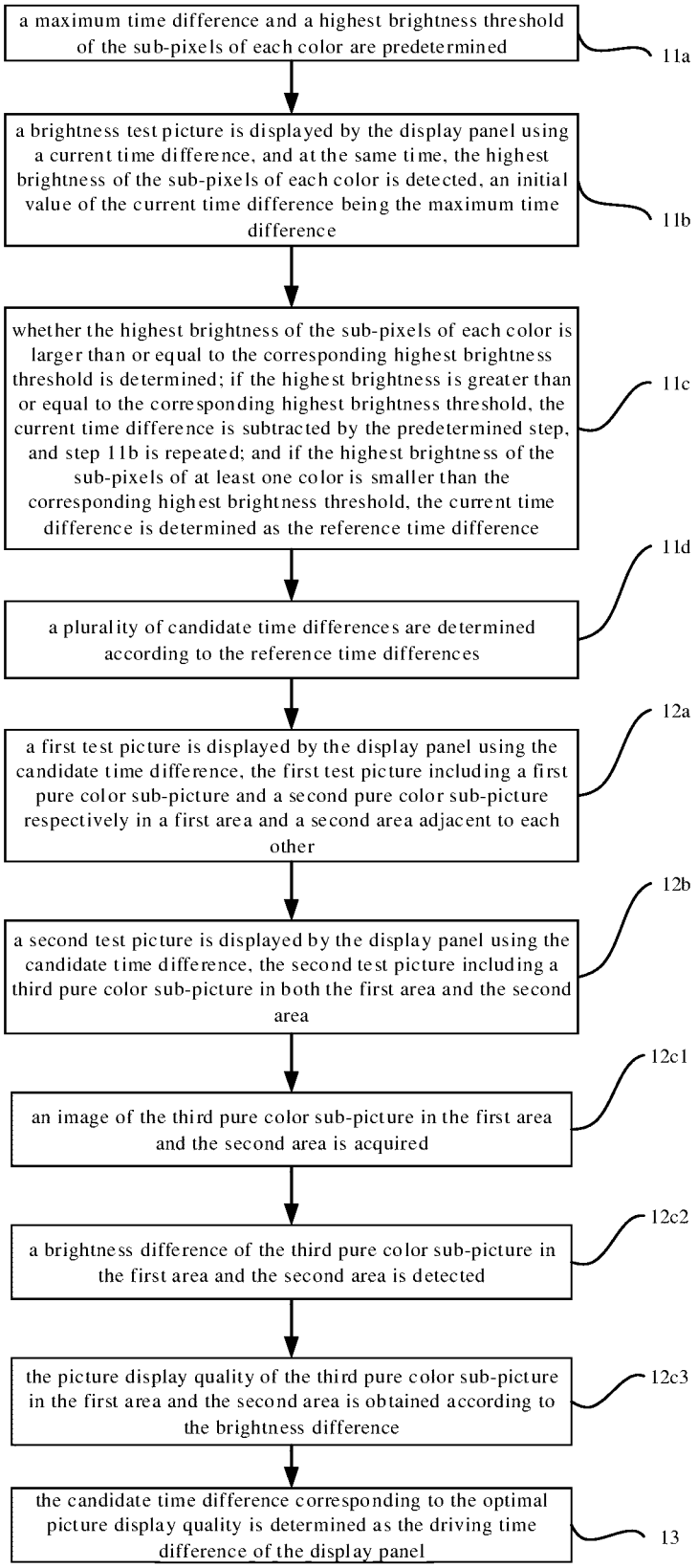
FIG. 4 is a flowchart of a method for determining a driving time difference of a display panel according to another embodiment of the present disclosure.

In some embodiments, referring to FIG. 4, step 11 includes step 11*a*, step 11*b*, step 11*c*, and step 11*d*.

At step 11*a*, a maximum time difference and a highest brightness threshold of the sub-pixels of each color are predetermined.

In this step, the highest brightness threshold of the sub-pixels of each color may be set according to experience and actual needs. When the display panel displays an image with the maximum time difference, the highest brightness which can be reached by the sub-pixels of each color is no less than the highest brightness threshold corresponding to the sub-pixels of the color.

At step 11*b*, a brightness test picture is displayed by the display panel using a current time difference, and at the same time, the highest brightness of the sub-pixels of each color is detected. An initial value of the current time difference is the maximum time difference.

At step 11*c*, whether the highest brightness of the sub-pixels of each color is larger than or equal to the highest brightness threshold of the sub-pixels of the color is determined; if the highest brightness of the sub-pixels of each color is greater than or equal to the highest brightness threshold thereof, the current time difference is subtracted by a predetermined step, and step 11*b* is repeated; and if the highest brightness of the sub-pixels of at least one color is smaller than the highest brightness threshold thereof, the current time difference is determined as the reference time difference.

In this step, the smaller the step is, the more "highest brightness" can be obtained, and thus, the number of the time difference samples is increased, but this also increases the number of iterative calculations, and increases the calculation cost. Therefore, a suitable step needs to be set empirically, and may be 1 μs, for example.

At step 11*d*, a plurality of candidate time differences are determined according to the reference time difference.

In some embodiments, the plurality of candidate time differences includes: T, T+step, . . . , T+n*step, T−step, . . . , T−m*step, where T is the reference time difference, step is the predetermined step, and m and n are integers greater than 1. For example, the plurality of candidate time differences include T, T+step, T+2*step, and T−step.

In some embodiments, step 13 includes: determining the candidate time difference corresponding to the optimal picture display quality according to the picture evaluation index, wherein the picture evaluation index includes one or any combination of brightness uniformity, highest brightness of the sub-pixels of each color, afterimage level and number of mura.

The picture display quality of the test picture on the display panel can be objectively evaluated by using the picture evaluation indexes, so that the watching experience of a user is improved.

In order to simplify the method for determining the driving time difference X, the picture evaluation index in step 13 may include a plurality of picture evaluation indexes, and each picture evaluation index has an evaluation priority; determining the candidate time difference corresponding to the optimal picture display quality according to the picture evaluation index includes: determining the candidate time difference corresponding to the optimal picture display quality according to the evaluation priorities of the picture evaluation indexes. For example, the priorities of the picture evaluation indexes in order from high to low may be as follows: brightness uniformity, highest brightness of sub-pixels of each color, afterimage level, number of mura.

Figure 6:
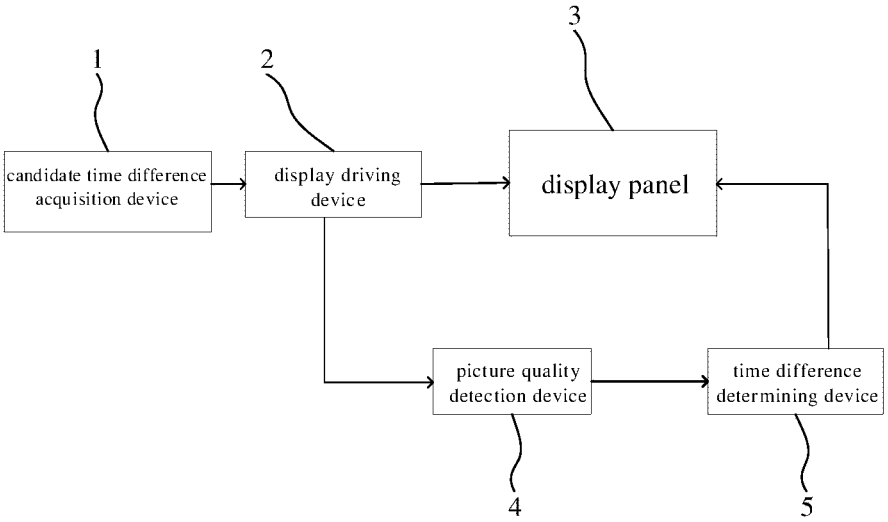
FIG. 6 is a block diagram of a driving device of a display panel according to an embodiment of the present disclosure.

Referring to FIG. 6, embodiments of the present disclosure provide a device for driving a display panel, the display panel 3 includes a plurality of sub-pixels of different colors, each sub-pixel includes a driving element, a first switch, a second switch, a light emitting device, and a storage unit; a control terminal of the first switch is coupled to a first control terminal, a first terminal of the first switch is coupled to a data line, and a second terminal of the first switch is coupled to a control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device; the storage unit is coupled between the control terminal of the driving element and the first terminal of the light emitting device.

The driving device includes a candidate time difference acquisition device 1, a display driving device 2, a picture quality detection device 4, and a time difference determining device 5.

The candidate time difference acquisition device 1 is configured to determine a plurality of candidate time differences according to the highest brightness threshold of the sub-pixels of each color. The candidate time difference acquisition device 1 may be implemented in the form of hardware and/or software, which is not limited in the present disclosure. For example, the candidate time difference acquisition device 1 may be implemented by a processor.

The display driving device 2 is configured to cause the display panel 3 to display a same test picture with one of the plurality of candidate time differences. During a period of writing a data signal to any sub-pixel, the display driving device 2 is configured to simultaneously provide an on signal to the first control terminal and the second control terminal of the sub-pixel, and then provide an off signal to the second control terminal before providing an off signal to the first control terminal, and a time difference between providing the off signal to the first control terminal and providing the off signal to the second control terminal is the one of the candidate time differences.

The picture quality detection device 4 is configured to detect the picture display quality of the display panel 3 when the test picture is displayed by the display panel 3 with each candidate time difference.

The time difference determining device 5 is configured to determine a candidate time difference corresponding to the optimal picture display quality. The time difference determining device 5 may be implemented in the form of hardware and/or software, which is not limited in the present disclosure. The time difference determining device 5 may be implemented by a processor, for example.

In the driving device according to the present disclosure, the brightness of the test picture is acquired by the picture quality detection device 4, and the brightness of the test picture acquired by the picture quality detection device 4 is an objective value, and therefore, the evaluation indexes of the picture display quality of the test picture obtained based on the brightness value of the test picture, such as brightness uniformity, highest brightness of sub-pixels of each color, afterimage level, number of mura, and the like, are also objective. Therefore, the driving device according to the present disclosure can objectively evaluate the picture display quality of the test picture on the display panel, and thus, the determined "time difference" can better balance the brightness and the afterimage problem of the display panel.

In some embodiments, the picture quality detection device includes:

an image acquisition device configured to acquire an image of the test picture; and an image analysis device configured to determine the picture display quality of the test picture according to the image of the test picture.

In some embodiments, the image acquisition device may be a charge coupled device (CCD), and the image analysis device may be a software program having functions of analyzing three primary color values of the captured image and calculating brightness values of the captured image from the three primary color values of the captured image.

The display panel in the present disclosure may be any product or component having an internal compensation pixel circuit, such as an OLED display panel, an electronic paper, a mobile phone, a tablet computer, a television, a display, a notebook computer, a digital photo frame, a navigator, or the like.

It should be noted that, relational terms such as first, second, and the like used herein are solely for distinguishing one entity or action from another entity or action without necessarily requiring or implying any actual relationship or order between the entities or actions. Furthermore, the terms "include", "comprise", or any other variation thereof, are intended to cover a non-exclusive inclusion, such that a process, method, article, or device that includes a list of elements not only includes those elements but also may include other elements not expressly listed or inherent to such process, method, article, or device. Without further limitation, an element defined by the phrase "including an . . . " does not exclude the presence of other identical elements in the process, method, article, or device that includes the element.

The embodiments of the present disclosure are described above, and these embodiments are not intended to be exhaustive or to limit the present disclosure to the precise embodiments disclosed. Obviously, many modifications and variations are possible in light of the above teaching. The embodiments are chosen and described in order to better explain the principles and the practical application of the present disclosure, to thereby enable others skilled in the art to utilize the present disclosure and various embodiments with various modifications as are suited to the particular use contemplated. The present disclosure is to be limited only by the claims and their full scope and equivalents.

The invention claimed is:

1. A method for driving a display panel, wherein the display panel comprises a plurality of sub-pixels of different colors, each sub-pixel comprising a driving element, a first switch, a second switch, and a light emitting device; a control terminal of the first switch is coupled to a first control terminal, a first terminal of the first switch is coupled to a data line, and a second terminal of the first switch is coupled to a control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device; the method comprises:

during a period of writing a data signal to any one of the plurality of sub-pixels, simultaneously providing an on signal to the first control terminal and the second control terminal of the sub-pixel, and then providing an off signal to the second control terminal before providing an off signal to the first control terminal, wherein a time difference between providing the off signal to the first control terminal and providing the off signal to the second control terminal is determined by:

determining a plurality of candidate time differences according to a highest brightness threshold of the sub-pixels of each color;

for each candidate time difference, displaying, by the display panel, a same test picture using the candidate time difference, and detecting picture display quality of the display panel when the test picture is displayed by the display panel using the candidate time difference; and determining a candidate time difference corresponding to an optimal picture display quality as the time difference.

2. The method of claim 1, wherein for each candidate time difference, steps of displaying, by the display panel, the same test picture using the candidate time difference, and detecting picture display quality of the display panel when the test picture is displayed by the display panel using the candidate time difference comprise:

displaying, by the display panel, a first test picture using the candidate time difference, wherein the first test picture comprises a first pure color sub-picture and a second pure color sub-picture which are respectively in a first area and a second area, the first area and the second area being adjacent to each other, the first pure color sub-picture has a first gray level, and the second pure color sub-picture has a second gray level;

displaying, by the display panel, a second test picture using the candidate time difference, wherein the second test picture comprises a third pure color sub-picture in both the first area and the second area, the third pure color sub-picture has a third gray level, and the third gray level is between the first gray level and the second gray level; and detecting the picture display quality of the third pure color sub-picture in the first area and the second area.

3. The method of claim 2, wherein detecting the picture display quality of the third pure color sub-picture in the first area and the second area comprises:

collecting an image of the third pure color sub-picture in the first area and the second area;

detecting a brightness difference between a brightness of the third pure color sub-picture in the first area and a brightness of the third pure color sub-picture in the second area; and acquiring the picture display quality of the third pure color sub-picture in the first area and the second area according to the brightness difference.

4. The method of claim 3, wherein collecting the image of the third pure color sub-picture in the first area and the second area comprises capturing, by a charge coupled device, an image of the second test picture displayed on the display panel.

5. The method of claim 3, wherein the first test picture comprises a plurality of pure color sub-pictures arranged in a matrix, and any two adjacent pure color sub-pictures are the first pure color sub-picture and the second pure color sub-picture, respectively.

6. The method of claim 2, wherein one of the first gray level and the second gray level is a minimum display gray level of the display panel, the other of the first gray level and the second gray level is a maximum display gray level of the display panel, and the third gray level is an intermediate value between the minimum display gray level and the maximum display gray level of the display panel.

7. The method of claim 1, further comprising restarting the display panel before displaying, by the display panel, the test picture using any candidate time difference and detecting picture display quality of the display panel when the test picture is displayed by the display panel using the candidate time difference.

8. The method of claim 1, further comprising predetermining a maximum time difference and the highest brightness threshold of the sub-pixels of each color, wherein determining the plurality of candidate time differences according to the highest brightness threshold of the sub-pixels of each color comprises:

displaying, by the display panel, a brightness test picture using a current time difference, and at the same time, detecting a highest brightness of the sub-pixels of each color, wherein an initial value of the current time difference is the maximum time difference;

judging whether the highest brightness of the sub-pixels of each color is greater than or equal to a corresponding highest brightness threshold;

in response to the highest brightness of the sub-pixels of each color being greater than or equal to the corresponding highest brightness threshold, subtracting a predetermined step from the current time difference and repeatedly performing the displaying, the detecting and the judging;

determining the current time difference as a reference time difference in response to the highest brightness of the sub-pixels of at least one color being less than a corresponding highest brightness threshold; and determining the plurality of candidate time differences according to the reference time difference.

9. The method of claim 8, wherein the plurality of candidate time differences comprises: T, T+step, . . . , T+n*step, T−step, . . . , T−m*step, where T is the reference time difference, step is the predetermined step, and m and n are integers greater than 1.

10. The method of claim 8, wherein in a case of the maximum time difference, the highest brightness that the sub-pixels of each color of the display panel are capable of reaching is no less than the highest brightness threshold of the sub-pixels of the color.

11. The method of claim 1, wherein determining a candidate time difference corresponding to an optimal picture display quality as the time difference comprises: determining the candidate time difference corresponding to the optimal picture display quality according to a picture evaluation index, wherein the picture evaluation index comprises one or any combination of brightness uniformity, highest brightness of sub-pixels of each color, afterimage level and number of mura.

12. The method of claim 11, wherein the picture evaluation index comprises a plurality of picture evaluation indexes, and determining the candidate time difference corresponding to the optimal picture display quality according to the picture evaluation index comprises: determining the candidate time difference corresponding to the optimal picture display quality according to priorities of the plurality of picture evaluation indexes.

13. A device for driving a display panel, wherein the display panel comprises a plurality of sub-pixels of different colors, each sub-pixel comprising a driving element, a first switch, a second switch, and a light emitting device; a control terminal of the first switch is coupled to a first control terminal, a first terminal of the first switch is coupled to a data line, and a second terminal of the first switch is coupled to a control terminal of the driving element; a control terminal of the second switch is coupled to a second control terminal, a first terminal of the second switch is coupled to a sensing line, and a second terminal of the second switch is coupled to a first terminal of the driving element and a first terminal of the light emitting device;

the driving device comprises:

a candidate time difference acquisition device configured to determine a plurality of candidate time differences according to a highest brightness threshold of the sub-pixels of each color;

a display driving device configured to cause the display panel to display a same test picture using one of the plurality of candidate time differences, wherein during a period of writing a data signal to any one of the plurality of sub-pixels, the display driving device is configured to simultaneously provide an on signal to the first control terminal and the second control terminal of the sub-pixel, then provide an off signal to the second control terminal before providing an off signal to the first control terminal, and a time difference between providing the off signal to the first control terminal and providing the off signal to the second control terminal is the one of the plurality of candidate time differences;

a picture quality detection device configured to detect picture display quality of the display panel when the test picture is displayed by the display panel using each candidate time difference; and a time difference determining device configured to determine a candidate time difference corresponding to an optimal picture display quality.

14. The device of claim 13, wherein the picture quality detection device comprises:

an image acquisition device configured to acquire an image of the test picture; and an image analysis device configured to determine the picture display quality of the test picture according to the image of the test picture.

* * * * *